United States Patent [19]

Guinn et al.

[11] 4,230,190

[45] Oct. 28, 1980

[54] BLOW OUT PREVENTER HANDLING SYSTEM

[76] Inventors: David C. Guinn; Archie K. Haggard; John P. Thomas, all of P.O. Box 1126, Houston, Tex. 77001

[21] Appl. No.: 952,031

[22] Filed: Oct. 13, 1978

Related U.S. Application Data

[60] Continuation of Ser. No. 840,944, Oct. 11, 1977, abandoned, which is a division of Ser. No. 729,494, Oct. 4, 1976, Pat. No. 4,081,163.

[51] Int. Cl.[2] ..... E21B 7/12

[52] U.S. Cl. ..... 175/5; 175/85; 166/362

[58] Field of Search ..... 175/5, 7, 85; 114/264; 166/362, 352, 354, 368

[56] References Cited

U.S. PATENT DOCUMENTS

| | | | |
|---|---|---|---|
| Re. 26,290 | 10/1967 | Rand | 175/7 X |
| 2,981,346 | 4/1961 | Bauer et al. | 175/5 |
| 3,043,255 | 7/1962 | Bauer et al. | 175/7 X |
| 3,189,093 | 6/1965 | Derries | 166/362 X |
| 3,498,375 | 3/1970 | McEwen et al. | 175/5 |
| 3,498,392 | 3/1970 | Knorr | 175/5 |
| 3,699,688 | 10/1972 | Estes | 61/91 |
| 3,766,874 | 10/1973 | Helm et al. | 114/264 |
| 3,817,412 | 6/1974 | Mercier et al. | 114/264 |
| 3,902,554 | 9/1975 | Hooper | 175/5 |
| 3,981,369 | 9/1976 | Bokenkamp | 175/5 |

*Primary Examiner*—Ernest R. Purser
*Assistant Examiner*—Richard E. Favreau
*Attorney, Agent, or Firm*—Fulbright & Jaworski

[57] ABSTRACT

A system for testing and installing a blow out preventer on a floating vessel and offshore drilling rigs, although the system may be used on other rotary drilling rigs, is disclosed. Retractable rotary table supporting beams are disposed over the moon pool and the rotary table is releasably connected to them. Retractable sub-structure beams are provided below the rotary table so that means provided to move the assembled blow out preventer can move it through an opening in the derrick and over the moon pool when the rotary beams are retracted. Retractable moon pool skid beams are provided which support the blow out preventer when skidded through the moon pool opening in the sub-structure.

In one aspect of the invention, the means connecting the rotary table to its support beams are self-aligning to that once the rotary table is aligned it can be removed and replaced without any further alignment. Also, support shoulders are provided on the main blow out preventer and lower riser section thereof which engage and are supported by the moon pool beams, so that the rotary support beams, rotary table and sub-structure support beams can be replaced and the blow out preventer hooked up to the riser, drill string or casing, the moon pool beams retracted and the blow out preventer lowered in the moon pool to the sea floor.

14 Claims, 9 Drawing Figures

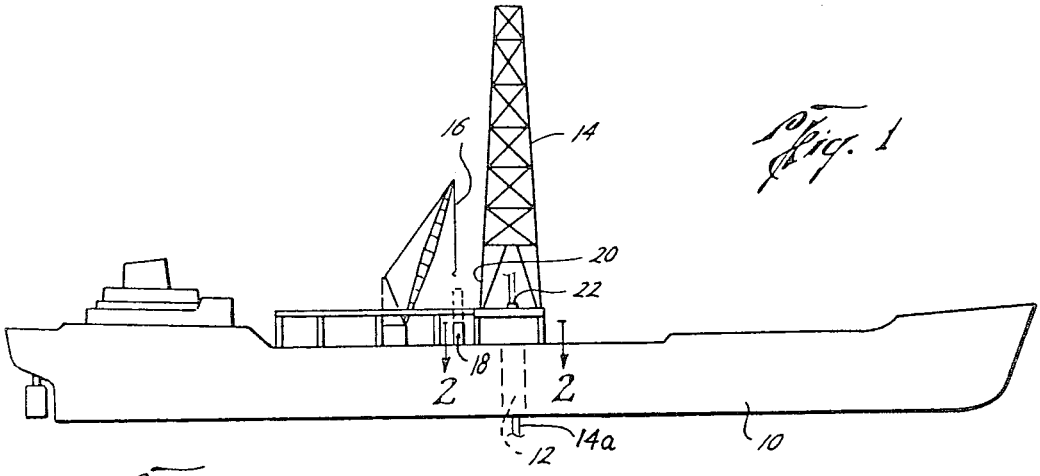
Fig. 1
Fig. 2
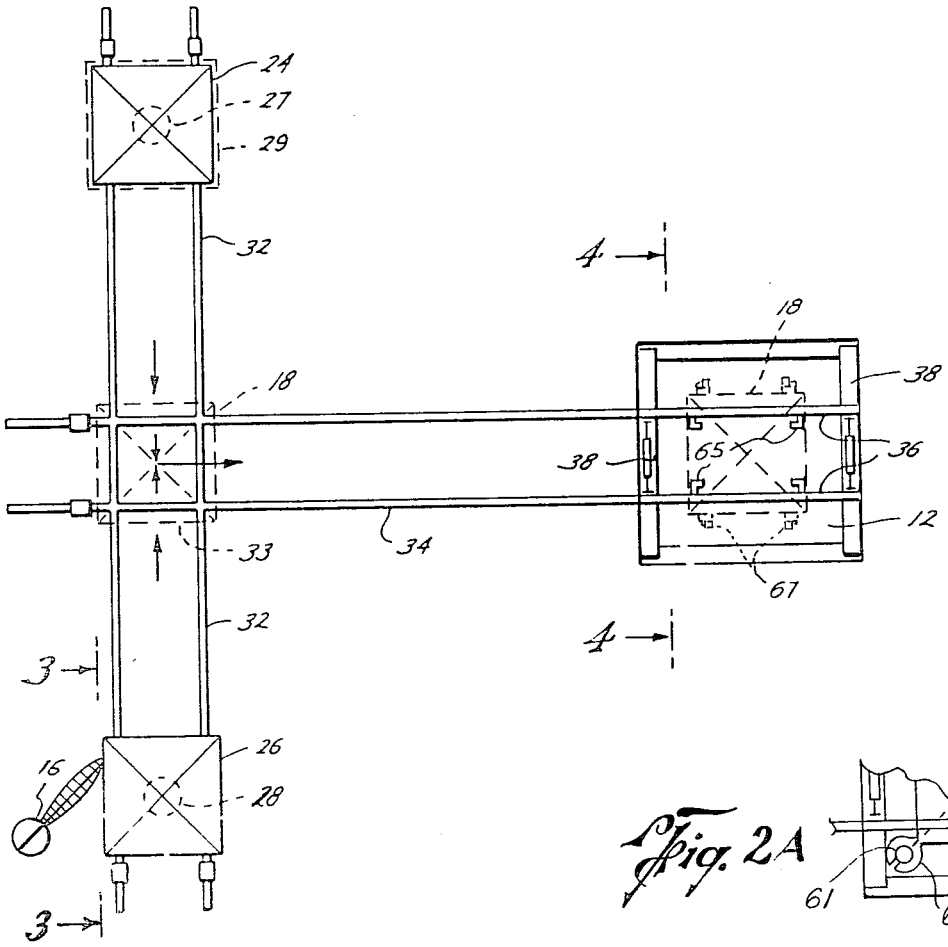
Fig. 2A
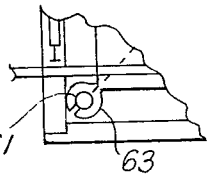

16
24
18
67
26
28
30
40
32

24
50
67
18
26
40
30
65
36

Fig. 7
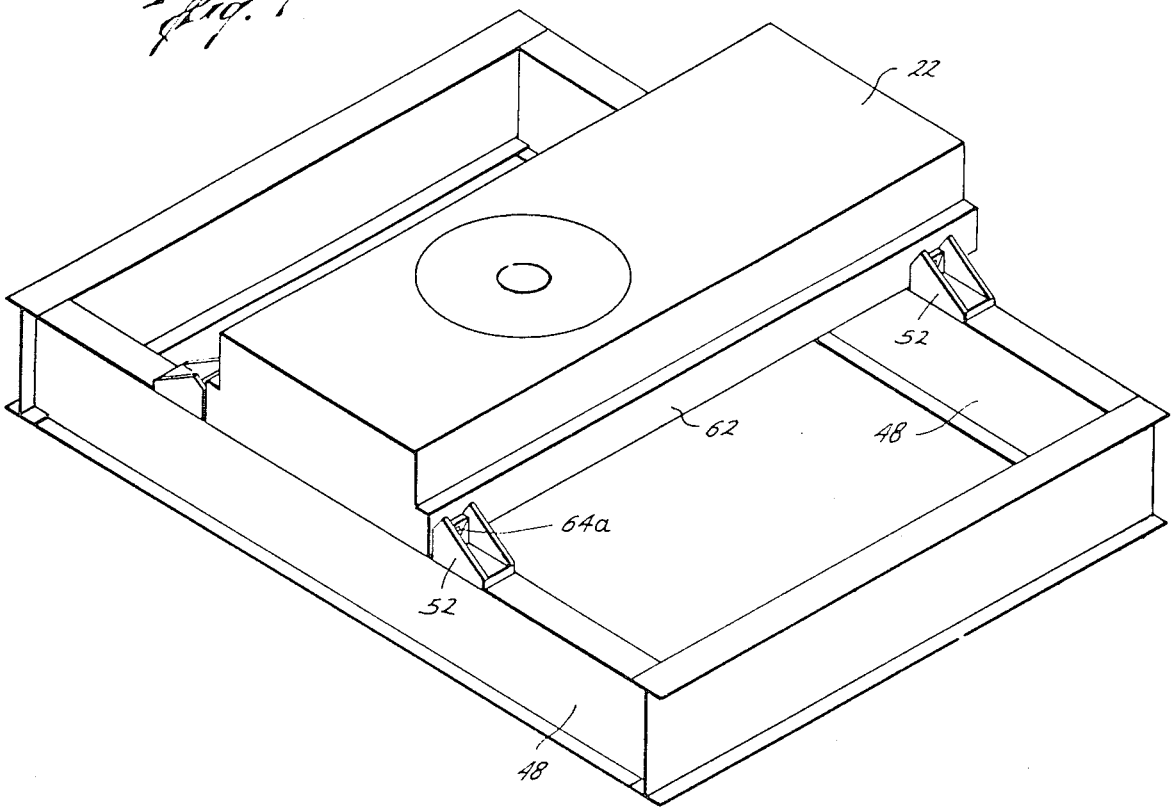
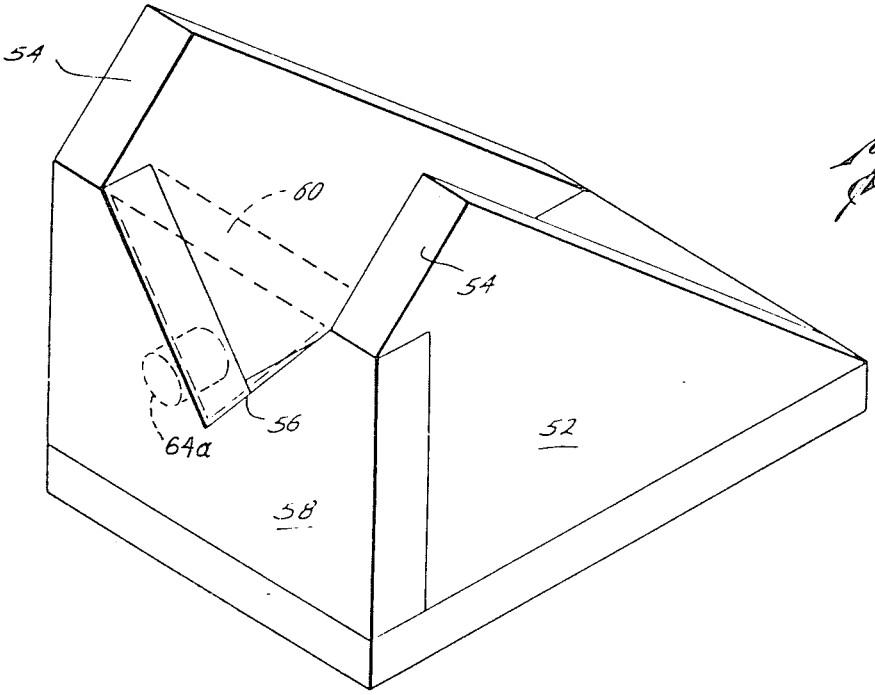
Fig. 8

BLOW OUT PREVENTER HANDLING SYSTEM

This application is a continuation of Ser. No. 840,944, filed Oct. 11, 1977, now abandoned, which is a division of Ser. No. 729,494 filed Oct. 4, 1976, now U.S. Pat. No. 4,081,163, issued Mar. 28, 1978.

BACKGROUND OF THE INVENTION

The assembly, testing and handling of modern blow out preventer stacks on offshore floaters and drilling rigs is a major consideration in conducting an efficient and safe operation under the dynamic conditions of a marine environment. High day rates for labor and capital investment dictate the adoption of a design for material handing which will reduce installation time so that drilling can be started as soon as feasible.

In order to facilitate operations and enhance safety it is desirable to assemble and test the upper and lower blow out preventer stacks on a test stump prior to the completed unit being moved over the moon pool. Also, in floating vessels, forces due to the roll of the vessel should be minimized as the blow out preventer stacks are quite heavy and the means for moving the assembled blow out preventers into position over the moon pool should not be affected by ship dynamics and should be capable of maintaining a positive control in both forward and reverse directions so that the accelerative forces imparted to such means in the direction of motion due to pitch and roll do not create an uncontrollable runaway situation as a result of the additive effect of energy input in the diretion of motion.

The following United States patents generally set forth the state of the art; however, most of them merely disclose various means for moving equipment from various areas of storage to a position over the drilling well (moon pool) of a vessel, U.S. Pat. Nos.: 3,031,167; 3,043,255; 3,177,954; 3,189,093; 3,333,562; 3,662,822; 3,699,688; 3,739,736; 3,766,874; and 3,802,209.

None of these patents, however, discloses or suggests the blow out preventer handling system, and the self-aligning connection for the rotary table, of the present invention.

SUMMARY

Accordingly, the present invention is directed to a system for installing a blowout preventer, well suited for use in drilling offshore and particularly from floating vessels, where the assembly, testing and handling of modern blow out preventer stacks is a major consideration in conducting an efficient and safe operation under the dynamic conditions of the marine environment, and in which high day rates for labor and capital investment dictate the adoption of a system which reduces installation time so that drilling can be started as soon as possible, and by which forces due to the pitch and roll of the vessel are minimized.

It is therefore an object of the present invention to provide a blow out preventer handing system by which a blow out preventer can be readily, quickly and safely installed so that drilling can be started as soon as possible.

A further object of the present invention is the provision of a blow out preventer handling system in which the blow out preventer stacks can be assembled, tested, and handled in an efficient and safe operation—particularly under the dynamic conditions of a marine environment.

It is a further object of the present invention to provide a blow out preventer handling system in which forces due to the roll, pitch and heave of a floating vessel are minimized.

A further object of the present invention is the provision of a blow out preventer handling system in which the blow out preventer can be assembled and tested on a test stump at location of the well to be drilled prior to the assembled unit being moved over the moon pool.

Yet a further object of the present invention is provision of a blow out preventer handling system in which retractable sub-structure girder support beams and rotary table supporting beams are provided and a rotary table is releasably secured to the rotary table support beams so that the rotary table and its supporting beams can readily be removed for passage of an assembled blow out preventer through the V-door of the derrick and over the moon pool without further structural modifications.

A further object of the present invention is the provision of a blow out preventer handling system in which unnecessary steps in handling the assembled blow out preventer stack are eliminated, such as lowering it from skid beams to spider deck beams, thereby avoiding excessive time delays usually encountered if a spider deck or false rotary is used.

It is a further object of the present invention to provide a self-aligning releasable connection for connecting the rotary table to its support structure, such as rotary table support beams, so that the rotary table can be readily released and replaced in self-alignment without any further alignment being necessary.

Another object of the present invention is to provide an efficient and safe guide support when lowering the blow out preventer through the moon pool.

Other and further objects, features and advantages appear throughout the specification and claims.

BRIEF DESCRIPTION OF THE DRAWINGS

FIG. 1 is a side view of a floating vessel having a blow out preventer handling system according to the present invention.

FIG. 2 is a view taken along the line 2—2 of FIG. 1.

FIG. 2A is a fragmentary view illustrating an alternate guide means to restrain the pendulum motion of the blow-out preventer stack as illustrated.

FIG. 7 is a perspective view illustrating the rotary table releasably connected to a supporting structure by means of self-aligning anchor members.

FIG. 8 is an enlarged perspective view illustrating the self-aligning anchor members.

DESCRIPTION OF PREFERRED EMBODIMENTS

Figure 3:
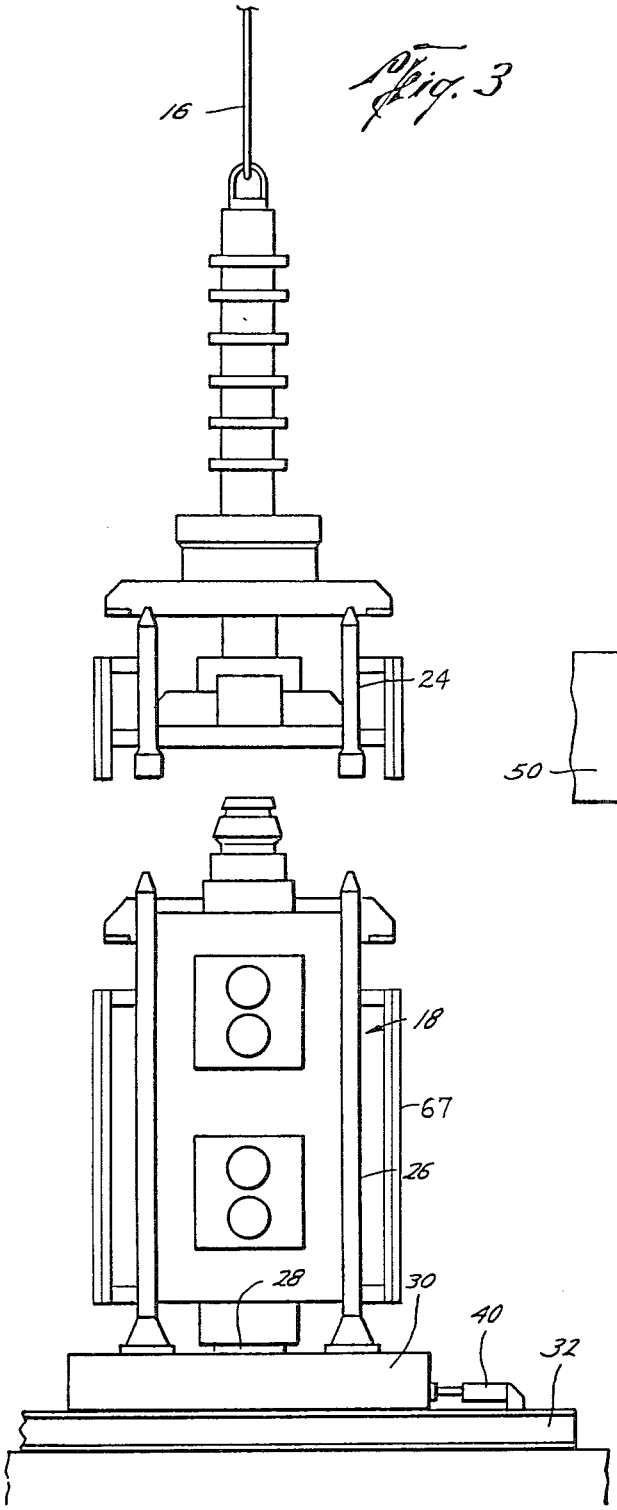
FIG. 3 is a view taken along the line 3—3 of FIG. 2.

Referring now to the drawings, and particularly to FIG. 1, the blow out preventer handling system is illustrated on a floating vessel 10 having the moon pool 12, derrick 14, drill string 14*a*, crane 16 and the blow out preventer stack or assembly 18, as well as other drilling components, tools and equipment used in the course of the rotary drilling of oil wells, not shown. While the blow out preventer handling system is particularly suited to the rotary drilling of wells from floating vessels, the system may be applied to other offshore drilling rigs and to drilling rigs on land, when desired.

The derrick 14 has an opening 20, the usual V-door, through which the blow out preventer 18 can be moved by removal of the central portion of the operating deck as described later, and also includes a rotary table 22 disposed over the moon pool 12 for usual rotary drilling operations.

Referring now to FIG. 2, the blow out preventer 18 is illustrated in two sections, the upper section 24 and the lower section 26 which may be located equidistant on opposite sides of the longitudinal axis of the vessel 10 to minimize forces due to roll. These forces are considerable when it is considered that some assembled blow out preventer stacks currently in use in subsea operations reach about 47 feet in height and weigh about 300,000 pounds.

Figure 4:
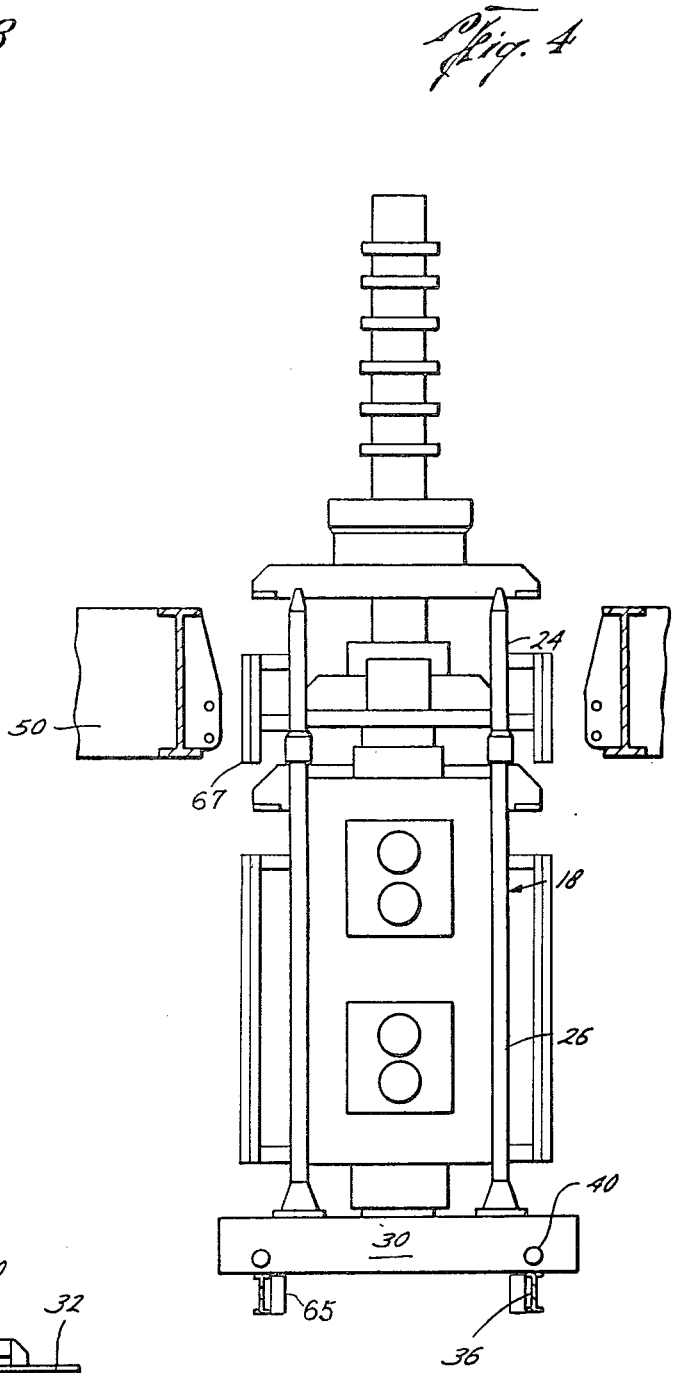
FIG. 4 is a view taken along the line 4—4 of FIG. 2.

The upper and lower sections 24 and 26 of the blow out preventer assembly are positioned on test stumps 27 and 28, respectively, which are integral portions of carriages or skids 29 and 30, the latter being better illustrated in FIGS. 3 and 4. One or more of such test stumps are provided and may be located as desired.

Transverse skid beams or tracks 32 and longitudinal skid tracks 34 are provided for skidding the skids 29 and 30 and for skidding the skid 30 over the moon pool 12, the longitudinal skid beams 34 having retractable skid beam portions 36 which are supported by the retractable sub-structure beams 38 disposed below the rotary table 22 and over the moon pool 12.

Thus, sections of the blow out preventer, here the upper 24 and lower 26, are positioned equidistant on opposite sides of the longitudinal axis of the vessel and, when on location, the upper section 24 is skidded on the skid rails 32 and then lifted by the crane 16 and placed on the lower section 26, as best seen in FIG. 3, where the blow out preventer stack is assembled and tested. The blow out preventer sections 24 and 26 can be assembled and tested anywhere desired, such as over the moon pool by using the derrick and traveling block, but preferably the assembly should be close to the crane 16.

The assembled blow out preventer stack 18 is then moved transversely by skidding the skid 30 on the skid rails or beams 32 to the cross-over position illustrated in dotted lines 33 in FIG. 2, where it is then skidded longitudinally on the skid rails 34 onto their retractable portions 36 over the moon pool 12.

In floating vessels, skidding of the upper and lower sections 24 and 26 on the transverse skid rails 32 and the assembled blow out preventer stack 18 on the transverse skid rails 32 and then on the longitudinal skid rails 34 requires a drive system which is not affected by ship dynamics and is capable of maintaining positive control in both forward and reverse directions. This is mandatory so that the accelerative forces imparted to the skid in the direction of motion due to pitch, roll and heave do not create an uncontrollable runaway situation as a result of the additive effect of energy input in the direction of motion. To this end, jacks are provided for moving the skids both in the transverse and longitudinal directions, such as illustrated at 40 in FIG. 4.

Figure 5:
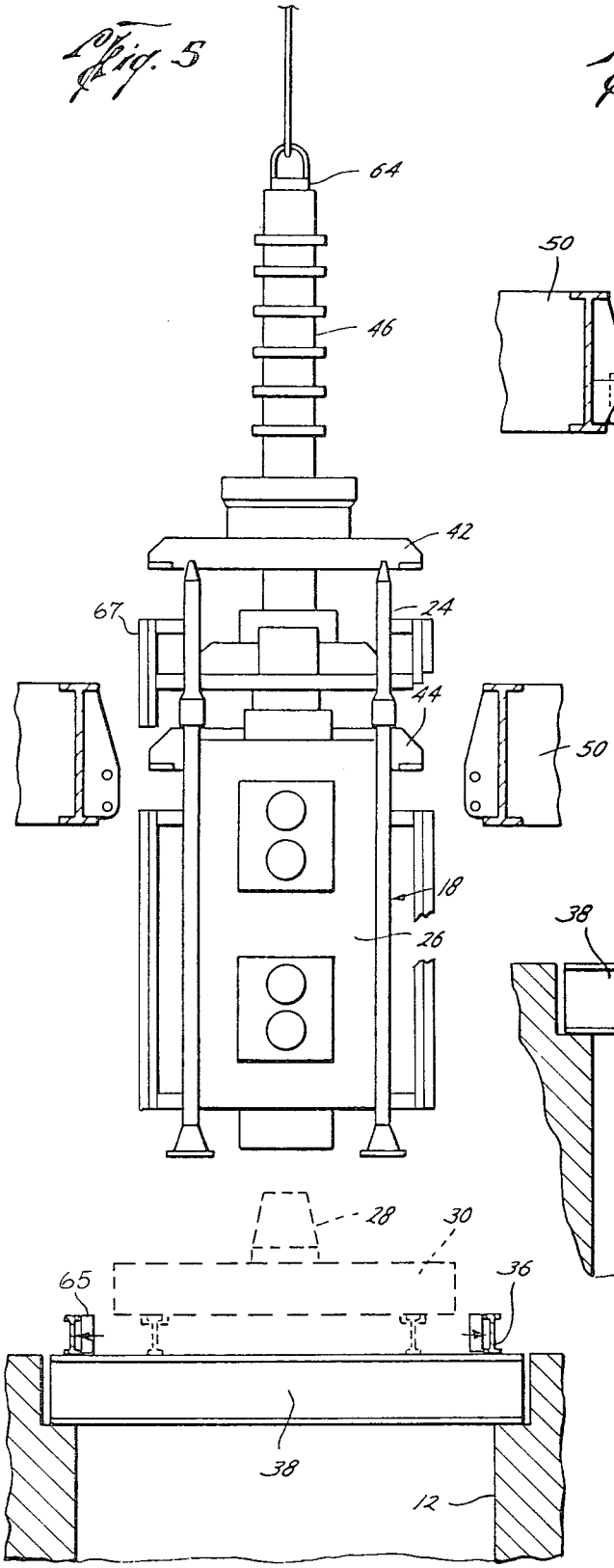
FIG. 5 is an elevational view illustrating the blow out preventer assembly being raised off of the test stump and skids over the moon pool.

As best seen in FIG. 5, the skids 30 are provided which are shaped to overlap the flanges of the skid beams 36 which prevent skid uplift and sidewise motions due to roll of the vessel 10.

Any type of jacks can be utilized, and preferably, the skid beams skids and skidding jacks should provide positive control thus avoiding a runaway situation and should be able to grip the rails and be able to move the blow out preventer stack 18 along the direction of motion with no manual resetting. Preferably, two independent pairs of jacks are utilized, one pair for transverse movement on the transverse skid beams or rails 32 and one pair for longitudinal movement on the longitudinal skid beams or rails 34. Such jacks are available on the market, such as gripper jacks sold by Hydranautics of Coleta, California, which fit and will grip various wide flange beams, such as the skid rails or beams 32 and 34. Accordingly, no more description of the jacks, gripping or clamping mechanism is given or shown in the drawings.

Figure 6:
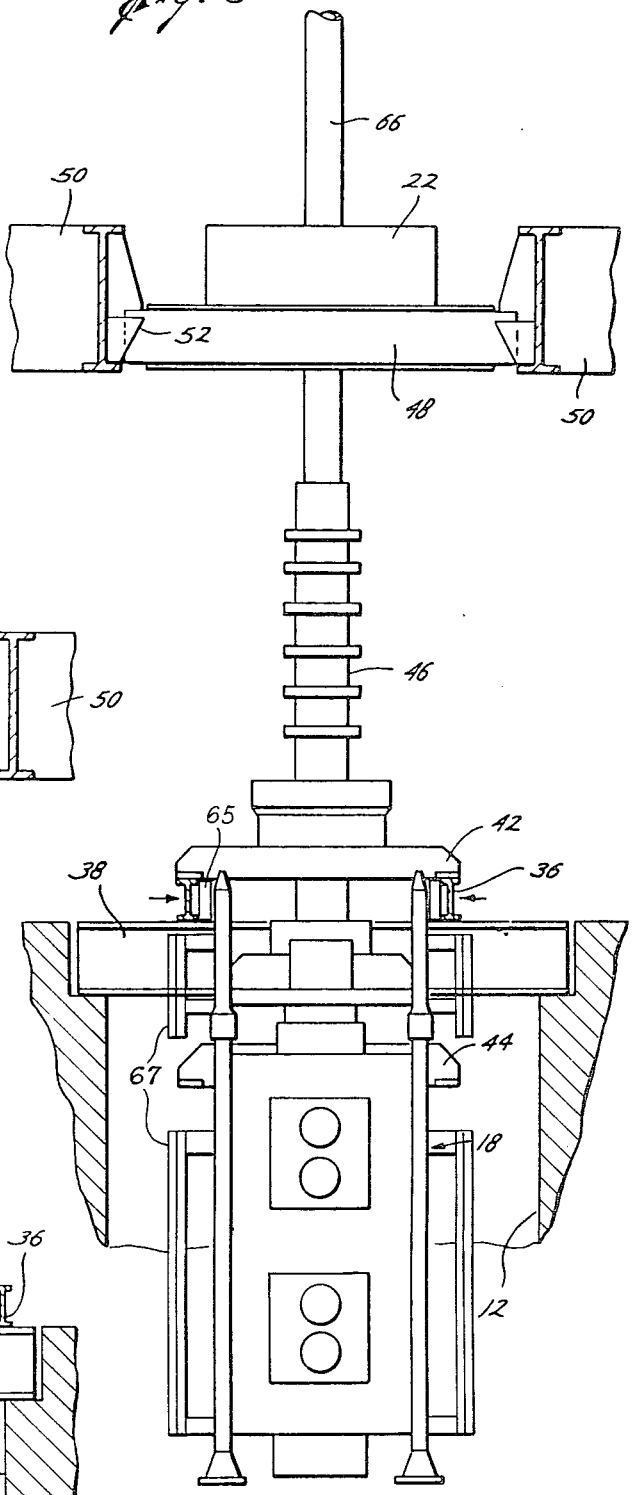
FIG. 6 is an elevational view illustrating the assembled blow out preventer being supported by its shoulders on removable sub-structure beams a vertical distance below the rotary table so that the rotary table and its support beams can be replaced at that time and the blow out preventer assembly connected to the drill string or casing and lowered to the bottom.

As best illustrated in FIGS. 3–6, a pair of shoulders 42 and a pair of shoulders 44, only one of each pair being shown, are disposed upon the upper section 24 and lower section 26 of the blow out preventer stack 18 to provide support for the assembled blow out preventer 18 in order to eliminate unnecessary steps previously used in handling it. While two pairs of shoulders 42 and 44 and preferred, only one pair of shoulders is necessary, and preferably, these should be on the upper section 24, which includes the riser 46 to which the drill string or casing is connected when the assembled blow out preventer 18 is lowered to bottom. The supporting shoulders 42 should be sufficiently high so that the riser 46 is below the rotary table 22 and its support beams 48 so that the rotary table 22 and its support beams 48 can be replaced while the blow out preventer stack 18 is supported by the shoulders 42 on the skid beams 36 as illustrated in FIG. 6.

Since the height of an assembled presently-used, commercial blow out preventer stack when mounted on the test stump 28 and the carriage or skid 30 is approximately 47 feet, and normally the clear height between the sub-structure operating deck is approximately 19 feet, in order to move the assembled blow out preventer stack 18 through V-door 20 of the derrick 14, the center section of the cross beams 50 of the operating platform are removable by providing the removable rotary table support beams 48 which are connected to the sub-structure beams 50 by the removable pins 52, as illustrated in FIG. 6. Reference is made to FIG. 4 which illustrates the rotary table support beams 48 and rotary table 22 removed and the blow out preventer stack 18 at a height where it can be and is being moved through the V-door, not shown, but indicated as the opening 20 (in FIG. 1) of the derrick 14.

Referring now to FIG. 7, the self-aligning anchor or connecting members for releasably connecting the rotary table 22 to the rotary table support structure in self-alignment, such as the beams 48, are illustrated. These include four anchor members 52*a* which are welded or otherwise secured to the rotary support beams 48, and as best illustrated in FIG. 8, each anchor member includes an inwardly tapered guide surface 54 at its upward inward portion and a V-slot portion 56 in its inner wall 58.

A co-acting V-member or wedge 60 is welded pinned by the pin 64A, or otherwise secured to a structural member 62 of the rotary member 22 which mates with the V-slot 56 in the anchor members 52. Preferably, the V-wedges 60 and V-slots 56 have equilateral sides.

Thus, once the anchor members 52 and V-members 60 are initially connected so that the rotary table 22 is aligned, no additional alignment is necessary when replacing the rotary table, the guide surfaces 54 and V-slots 56 of the anchors 52 and the wedge members 60, guiding the rotary table both transversely and longitudinally into the aligned position. This speeds up the removal and replacement of the table in going in and coming out of the moon pool, and resuming drilling operations. Thus, these rotary table connecting anchors provide a permanent and self-alignment for the rotary table 22 and provide an easy removal and reinstallation of it. This insures exact alignment for drilling purposes and for controls and piping installation.

When lowering the blow out preventer stack through the moon pool, guide means guides and slides are provided to restrain pendulum motion of the blow out preventer stack caused by vessel motion. Two such systems are illustrated, one using vertical guide posts 61 secured in the moon pool yoked to slide clamps 63 on the blow out preventer frame, as illustrated in FIG. 2A. The other uses the retractable moon pool beams 36 equipped with L-shaped guide members 65 to fit the slide tracks 67 mounted on the frame of the blow out preventer 18, as best seen in FIGS. 5 and 6. Such beams 38 are jacked inwardly to mate with the blow out preventer 18 tracks thereby restraining blow out preventer motion when running through the moon pool.

A preferred operation of the blow out preventer handling system is as follows:

The jacks 40 are installed on the skid beams 32 outboard both skids and fastened to the skids. The rotary table 22 and the rotary table support beams 48 are removed.

Locks and clamps (not shown) on the skid 29 of the upper blow out preventer 24 are released and the upper blow out preventer 24 is skidded to adjacent the lower blow out preventer 26 and locked in position, which position is adjacent the crane 16. The upper section 24 is released from its test stump and the crane 16 is utilized to lift the upper section 24 on the lower blow out preventer section 26, as illustrated in FIG. 3. The upper 24 and lower 26 blow out preventer sections are then assembled and tested to determine that they are operable for the purposes intended. No description of the test is given as the usual test for testing blow out preventers can be used.

The skid for the upper blow out preventer section 24 is then skidded back to its original position and locked in place. These jacks are then removed and installed on the outboard beam of the cross over section 33 illustrated in FIG. 2.

The skid 30 for the lower blow out preventer section 26 is then released and the assembled and tested blow out preventer is skidded to the cross over section 33 where it is then skidded longitudinally on the longitudinal skid beams or rails 34 and on to their retractable portions 36 over the moon pool 12. A make-up tool 64 at the top of the riser 46 is connected to a line from the traveling block, not shown, in the derrick 14 and the assembled blow out preventer stack 18 is lifted from its test stump 28 and skid 30, as illustrated in FIG. 5.

The skid 30 is unlocked, and skidded back to the crossover area 33 and then skidded back to its original position and locked into place by grippers, not shown on the skid 30. Preferably, the jacks are then removed and stowed.

The retractable portions 36 of the longitudinal skid rails 34 are then retracted and the assembled blow out preventer stack 18 lowered down into the moon pool 12 using either motion restraining system, previously described, until the pair of shoulders 42 on the upper section 24 come into proximity with the skid beams 36, which are then closed and locked into position, the assembled blow out preventer 18 then lowered until the shoulder 42 rests on the skid beams 36, thus supporting the assembled blow out preventer stack, as illustrated in FIG. 6. The make up tool 64 is then removed, and the rotary support beams 48 and rotary table 22 replaced for running the assembled blow out preventer stack to the sea floor. Normally, this is done with a riser string or casing 66 which is supported by the traveling block, not shown, in the derrick 14.

The assembled blow out preventer stack 18 is then lifted so that the shoulders 42 are off the skid beams 36, which skids are then retracted to an out of the way position, and the assembled blow out preventer stack 18 is then lowered to the sea floor through the moon pool while having pendulum motion restrained, as previously described. The sub-structure beams 38 may then be re-set, if desired, and locked into position or may be locked on the side of the moon pool or left in a vertical position flush with the moon pool bulkheads, as desired.

In operating the blow out preventer handling system, it is unnecessary to follow the exact sequence of steps described above, and the blow out preventer can be assembled at any desired location, but preferably should be assembled at a point close to or adjacent the crane 16. Advantageously, the blow out preventer system utilizes conventional equipment and drilling components found on rotary drilling rigs, which is the reason why no detailed description thereof is set forth, all of which are conventional and are used in normal rotary drilling operations.

Advantageously, the blow out preventer handling system eliminates unnecessary steps in the handling of assembled blow out preventer stacks, such as lowering it from skid beams to a spider deck beam or installing a false rotary in the drill floor, and the like. Thus, the blow out preventer stack can be readily lowered to the sea floor without entailing excessive time delays which are usually encountered if a spider deck or false rotary is used.

In addition, the self-aligning rotary table anchor members advantageously permit and provide self-alignment of the rotary table simply by replacing it.

In the event it is desired to remove a blow out preventer stack, the following steps can be taken. In general, these can comprise the reverse of the steps taken in assembling the blow out preventer stack and lowering it to the sub-sea floor. Since the blow out preventer does not have to be assembled and tested when being removed, it can simply be disconnected from the well head at the sub-sea floor, and raised to the position where the shoulders 44 are proximate the skids 36 which are then moved into position and the blow out preventer stack 18 lowered so that the retractable longitudinal skid portions 36 support the shoulders 44. The upper section 24 may then be disconnected from the lower section 26, the test stump and skid for the upper section attached and the upper section skidded to its original position.

When the blow out preventer is traveling through the water-air interface it is subject to a pendulum effect and enters the air since it is no longer is subject to the motion dampening effect of the water. Advantageously, such motion is restrained by the guide system, all as previously described.

The lower section 26 can then be raised, the skid 30 and test stump 28 reattached to the bottom portion and then skidded to its original position and locked in place.

The shoulders 42 and 44 are positioned so that the rotary table 22 and its support beams 48 do not have to be removed thereby avoiding the necessity and saving the time of removing them.

The present invention, therefore, is well suited and adapted to attain the objects and ends and has the advantages and features mentioned as well as others inherent therein.

While presently preferred embodiments of the invention have been given for the purposes of disclosure, changes may be made which are within the spirit of the invention as defined by the scope of the appended claims.

What is claimed is:

1. A system for testing and installing a blow out preventer on a floating vessel having a moon pool and a derrick over the moon pool, the derrick having an opening through which a portion of the blow out preventer can be moved and having means for lowering it into the moon pool comprising, retractable rotary table support beams disposed over the moon pool supporting a rotary table for rotating a drill string during rotary drilling operations, means releasably connecting the rotary table to the rotary table support beams, retractable substructure beams below the rotary table, test stump means means for positioning an upper section and a lower section of the blow out preventer on opposite sides of the longitudinal axis of the vessel, for placing the lower section of the blow out preventer on the test stump means and placing the upper section on the lower section, support shoulders extending from at least one of the upper and lower sections arranged to support the blow out preventer on the substructure beams, means operable to move the assembled blow out preventer through the derrick opening and space provided by the retracted substructure beams and over the moon pool, guide means operable to restrain swinging movement of the blow out preventer when moving it in the moon pool, whereby the upper section and the lower section of the blow out preventer can be positioned on opposite sides of the longitudinal axis of the vessel thereby minimizing forces due to the roll of the vessel, the upper section can be placed on the lower section and the blow out preventer assembled and tested on the test stump means and then moved through the derrick opening and space provided by the retracted rotary table support beams and over the moon pool and guided while being lowered until the support shoulders engage the retractable substructure beams, the rotary table support beams replaced and the rotary table connected to them, the upper section of the blow out preventer connected to the means to lower it, the blow out preventer lifted and the substructure beams retracted, and the blow out preventer then lowered in the moon pool.

2. The system of claim 1 where the means releasably connecting the rotary table to the rotary support beams comprise, coacting self-aligning anchor members connected to the retractable rotary support beams and to the rotary table arranged to self-align the rotary table upon securing it to the rotary table support beams.

3. The system of claim 1 where the means releasably connecting the rotary table to the rotary table support beams comprise, anchor members connected to the retractable rotary table support beams, the anchor members including inwardly tapered upper guide surfaces and having V-slot portions in their upper ends, V-members secured to the rotary table mating in the V-slot portions, the guide surfaces, V-slot portions and V-members guiding the rotary table into a transversely and longitudinally aligned position over the moon pool, whereby the rotary table can be removed from the rotary table support beams and replaced in alignment by placing the V-members in the V-slots.

4. The system of claim 1 where the means arranged to move the assembled blow out preventer through the opening in the derrick and the space provided by the retractable substructure beams and over the moon pool comprise, skid beams having retractable portions extending over the moon pool, skids on the lower section of the blow out preventer slidable on the skid beams, and means operable to slide the skids on the skid beams.

5. The system of claim 1 where, the means releasably connecting the rotary table to the rotary table supporting beams comprise, anchor members connected to the retractable rotary table supporting beams, the anchor members including inwardly tapered upper guide surfaces and having V-slot portions in their upper ends, and V-members secured to the rotary table mating in the V-slot portions, the guide surfaces, V-slot portion and V-members guiding the rotary table into a transversely and longitudinally aligned position over the moon pool, whereby the rotary table can be removed from the rotary table supporting beams and replaced in alignment by placing the V-members in the V-slots, and where the means arranged to move the assembled blow out preventer through the opening in the derrick and the space provided by the retractable substructure beams and over the moon pool comprise, skid beams having retractable portions extending over the moon pool, skids on the lower section of the blow out preventer slidable on the skid beams, the skids including means restraining upward movement while on the skid beams, and means operative to slide the skids on the skid beams.

6. A system for testing and installing a blow out preventer on an offshore drilling rig having a moon pool and a derrick over the moon pool, the derrick having an opening through which a portion of the blow out preventer can be moved and having means for lowering it into the moon pool comprising, retractable rotary table supporting beams disposed over the moon pool supporting a rotary table for rotating a drill string during rotary drilling operations, and providing an additional opening below the opening in the derrick, means releasably connecting the rotary table to the rotary table support beams comprising co-acting, self-aligning anchor members connected to the retractable rotary table support beams and to the rotary table and arranged to self-align the rotary table upon connecting it to the rotary table support beams, means operable to move the assembled blow out preventer through the derrick opening and over the moon pool, whereby the rotary table and the rotary table supporting beams can be retracted from the moon pool, the blow out preventer moved through the openings and over the moon pool and lowered into the moon pool, the rotary table support beams replaced and the rotary table reconnected to them.

7. The system of claim 6 where the means releasably connecting the rotary table to the rotary support beams comprise, anchor members connected to the retractable rotary table support beams, the anchor members including inwardly tapered upper guide surfaces and having V-slot portions in their upper ends, and V-members secured to the rotary table mating in the V-slot portions, the guide surfaces, V-slot portions and V-members guiding the rotary table into a transversely and horizontally aligned position over the moon pool, whereby the rotary table can be removed from the rotary table support and replaced in alignment by placing the V-members in the V-slots.

8. The system of claim 6 including, retractable substructure beams below the rotary table, and support shoulders extending from the blow out preventer arranged to engage and support the blow out preventer on the substructure beams.

9. A system for testing and installing a blow out preventer on a floating vessel having a moon pool and a derrick over the moon pool, the derrick having an opening through which a portion of the blow out preventer can be moved and having means for lowering it into the moon pool comprising, retractable rotary table support beams disposed over the moon pool supporting a rotary table for rotating a drill string during rotary drilling operations, means releasably connecting the rotary table to the rotary table support beams, retractable substructure beams below the rotary table, test stump means, means for placing a lower section of the blow out preventer on the test stump means and placing an upper section of the blow out preventer on the lower section, support shoulders extending from at least one of the upper and lower sections arranged to support the blow out preventer on the substructure beams, means operable to move the assembled blow out preventer through the derrick opening and space provided by the retracted substructure beams and over the moon pool, guide means operable to restrain swinging movement of the blow out preventer when moving it in the moon pool, whereby the upper section and the lower section of the blow out preventer can be positioned on opposite sides of the longitudinal axis of the vessel thereby minimizing forces due to the roll of the vessel, the upper section can be placed on the lower section and the blow out preventer assembled and tested on the test stump means and then moved through the derrick opening and space provided by the retracted rotary table support beams and over the moon pool and guided while being lowered until the support shoulders engage the retractable substructure beams, the rotary table support beams replaced and the rotary table connected to them, the upper section of the blow out preventer connected to the means to lower it, the blow out preventer lifted and the substructure beams retracted, and the blow out preventer then lowered in the moon pool.

10. The system of claim 9 where the means releasably connecting the rotary table to the rotary support beams comprise, coacting self-aligning anchor members connected to the retractable rotary table support beams and to the rotary table arranged to self-align the rotary table upon securing it to the rotary table support beams.

11. The system of claim 17 where the means arranged to move the assembled blow out preventer through the opening in the derrick and the space provided by the retractable substructure beams and over the moon pool comprise, skid beams having retractable portions extending over the moon pool, skids on the lower section of the blow out preventer slidable on the skid beams, and means operable to slide the skids on the skid beams.

12. The system of claim 9 where the guide means comprise, vertically extending guides and slides on the blow out preventer and in the moon pool arranged to restrain the swinging motion of the blow out preventer.

13. The system of claim 12 where, the slides comprise vertical guide posts secured to the frame of the blow out preventer.

14. The system of claim 12 where, the slides comprise vertical tracks secured in the moon pool.

* * * * *